US006026624A

United States Patent [19]

Patel et al.

[11] Patent Number: 6,026,624

[45] **Date of Patent: *Feb. 22, 2000**

[54] BUILDING SIDING PANELS

[75] Inventors: Kiran A. Patel, Douglasville; Steven F. Quady, Smyrna, both of Ga.

[73] Assignee: Fabwel, Inc., Atlanta, Ga.

[ * ] Notice: Under 35 U.S.C. 154(b), the term of this patent shall be extended for 212 days.

[21] Appl. No.: 08/499,211

[22] Filed: Jul. 7, 1995

[51] Int. Cl.[7] ..... E04D 1/00

[52] U.S. Cl. ..... 52/529; 52/545; 52/547; 52/588.1

[58] Field of Search ..... 52/529, 530, 531, 52/535, 545, 547, 588.1

[56] References Cited

U.S. PATENT DOCUMENTS

| | | | |
|---|---|---|---|
| 3,239,985 | 3/1966 | Harter | 52/531 |
| 3,473,274 | 10/1969 | Godes | 52/531 X |
| 3,504,467 | 4/1970 | Hatch et al. | 52/531 X |
| 3,593,479 | 7/1971 | Hinds | 52/531 X |
| 3,886,704 | 6/1975 | Mattes | 52/530 |
| 4,015,391 | 4/1977 | Epstein et al. | 52/547 X |
| 4,267,679 | 5/1981 | Thompson | 52/545 X |
| 4,782,638 | 11/1988 | Hovind | 52/547 |
| 4,918,898 | 4/1990 | McLeod | 52/588.1 |
| 5,363,623 | 11/1994 | King | 52/545 X |
| 5,455,099 | 10/1995 | Banner | 52/530 X |

*Primary Examiner*—Carl D. Friedman
*Assistant Examiner*—Timothy B. Kang
*Attorney, Agent, or Firm*—Van Dyke, Gardner, Linn, & Burkhart, LLP

[57] ABSTRACT

A plastic siding panel for forming a weather-resistant facade on an exterior wall of a building, and which is resistant to being dislodged from the building wall by relatively high apparent wind velocities, which are frequently encountered during transportation of a prefabricated building module. The panel comprises a contoured sheet of a plastic material typically having an ornamental facing, a generally flat nailhem strip at an upper end thereof, and an elongate rib located on the nailhem strip. The rib provides additional strength and rigidity which makes the plastic siding panels of the invention significantly more resistant to dislodgement from a building wall, upon exposure to relatively high winds, than conventional plastic siding panels.

14 Claims, 2 Drawing Sheets

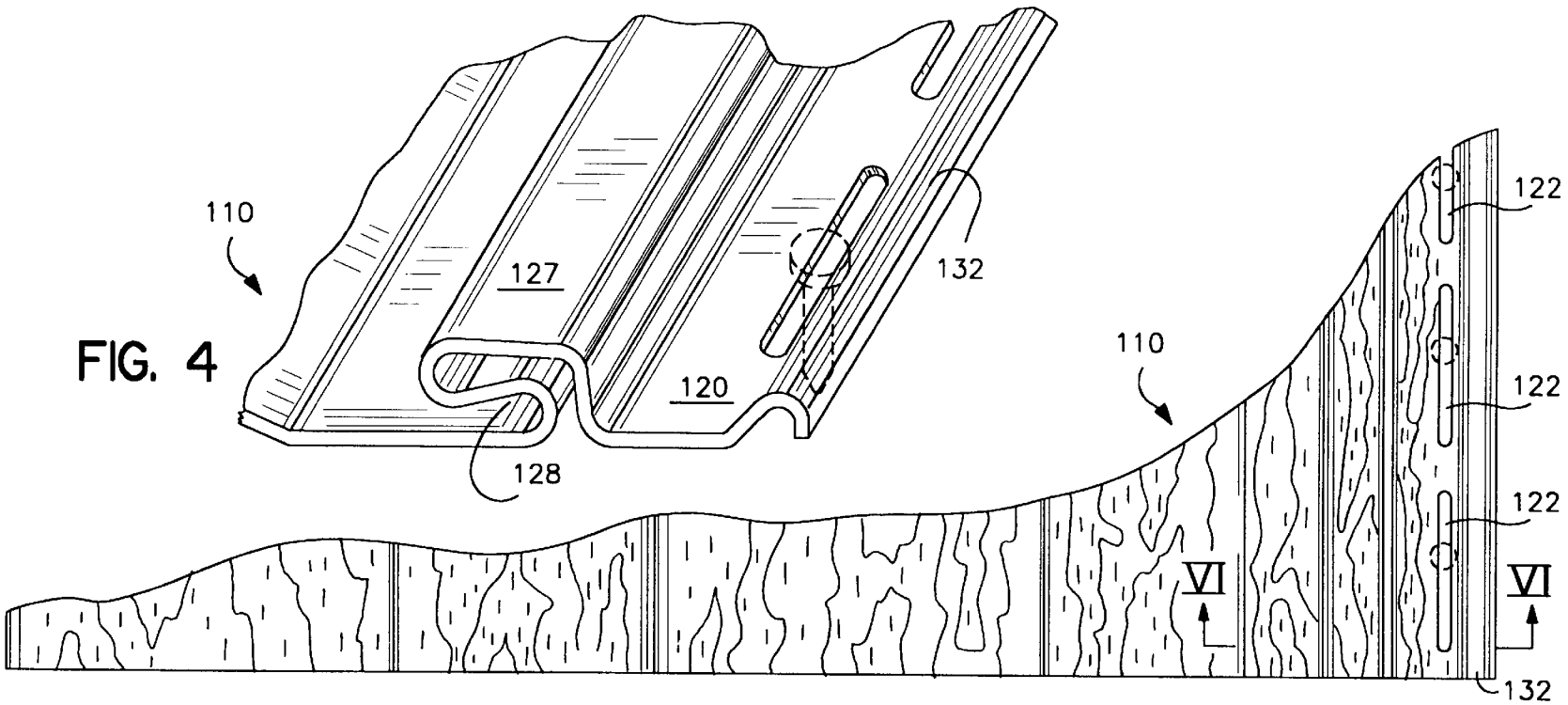
FIG. 4
FIG. 5
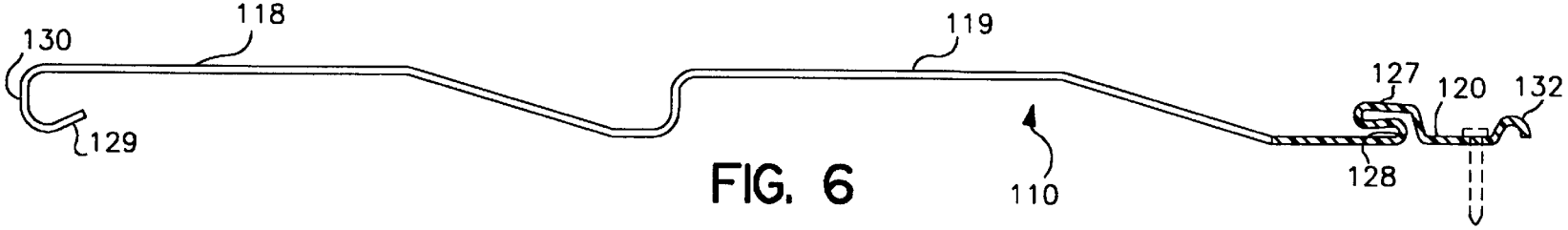
FIG. 6

BUILDING SIDING PANELS

BACKGROUND

This invention relates to plastic siding panels which are fastened to an exterior wall of a building to form a weather-resistant, ornamental facade.

Known plastic siding panels have a variety of designs and configurations intended to replicate the appearance of wooden siding. These plastic siding panels in many cases each include a number of surfaces that replicate a number of siding boards in a single panel. Typically, these vinyl siding panels have a flat upper edge referred to as a "nailhem," that is used to nail or fasten the panel to the building structure. Known plastic siding panels generally have a completely flat nailhem strip that extends along the upper edge. This nailhem strip normally includes a plurality of elongate apertures for passing a fastener therethrough in order to attach the siding panel to an exterior building wall. These known plastic siding strips, while generally suitable for buildings constructed on a building site, have a tendency to be sheared off or partially dislodged when subjected to a relatively high apparent wind velocity. Such a relatively high apparent wind velocity is often encountered when a mobile home or a prefabricated building module is being transported. As a result, it is common for manufacturers or owners to be required to replace or reattach conventional plastic siding panels on a prefabricated building module after it has been transported to the building site where the module is to be combined with at least one other prefabricated building module to form a substantially complete building. The sheared or dislodged building panels are often destroyed due to tearing of the nailhem and must be replaced. The reattachment of dislodged or damaged panels can involve a significant amount of time and/or labor. Replacement and reattachment of partially or completely dislodged plastic siding panels adds labor and material expense to the total cost of the completed prefabricated building.

There is, therefore, a significant need for plastic siding panels which are less susceptible to being dislodged when exposed to the relatively high apparent wind velocities to which siding on prefabricated building modules are frequently exposed.

SUMMARY

In accordance with one aspect of the invention, there is provided a siding panel comprising a contoured plastic sheet having an ornamental facing with a generally flat nailhem strip at the upper end thereof, and an elongate rib located on the nailhem strip. The rib on the nailhem strip adds strength and rigidity to the siding panel, making it more resistant to being dislodged from a building wall to which it is fastened, thereby significantly reducing or eliminating the need for replacing or reattaching completely or partially dislodged siding panels which have been exposed to a relatively high apparent wind velocity. While the panels of the invention are particularly useful on prefabricated building modules which are frequently exposed to relatively high apparent wind velocities when they are transported over roads and highways to a building site, the wind-resistant plastic siding panels of the invention can be advantageously utilized on buildings which are constructed on the building site, without adding significantly to the overall cost of construction. The panels of the invention might also be especially useful on conventional buildings which are constructed on a building site where high winds, such as from hurricanes, are frequently encountered.

The invention provides a modified plastic siding panel which can be produced at substantially the same cost of conventional plastic siding panels and provides the same weather-resistant properties and aesthetic characteristics of conventional plastic siding panels, while being significantly more resistant to being dislodged from a building wall when exposed to a relatively high apparent wind velocity. More particularly, the plastic siding panels of the invention can be made using conventional extrusion techniques, utilizing substantially the same amount of material to cover the same amount of exterior building wall area as conventional plastic siding panels, while significantly reducing or eliminating the need of replacing or reattaching siding panels after a building wall covered with the siding panels of the invention is exposed to a high apparent wind velocity, such as during transportation of a prefabricated building module, having such siding panels, to a building site.

The panels of the invention are preferably made of a vinyl plastic composition, especially a plastic composition comprising polyvinyl chloride. Desirably, the plastic panels of the invention have an ornamental facing which simulates wood strips. The siding panels of the invention preferably include a hook-like projection, adjacent to the nailhem strip, having an overlapping serpentine shape, as viewed from a side edge, and having an upwardly opening groove. The siding panels of the invention also preferably include a J-shaped hook located at the lower end thereof which engages the hook-like projection of a lower adjacent panel to lock or retain the panel along the lower edge thereof. In accordance with a preferred mode of the invention, the elongate rib is located at the upper edge of the nailhem strip.

Another aspect of the invention provides a prefabricated building module having wind-resistant siding panels. The wind-resistant siding panels comprise a contoured plastic sheet having an ornamental facing, a generally flat nailhem strip at an upper end thereof, and an elongate rib located on the nailhem strip.

Siding panels embodying the invention reduce costs associated with the transportation and assembly of prefabricated building modules without any adverse effects on the functionality or aesthetics of the siding. The invention can also be used on traditional buildings, which are constructed on site, to reduce potential repair expenses in the event that the siding is exposed to relatively high winds.

BRIEF DESCRIPTION OF THE DRAWINGS

FIG. 4 is a front perspective view of a plastic siding panel according to the invention;

FIG. 5 is a fragmentary front view of the siding panel shown in FIG. 4; and FIG. 6 is a side view of the siding panel shown in FIG. 4.

DESCRIPTION OF THE PREFERRED EMBODIMENT

Figure 1:
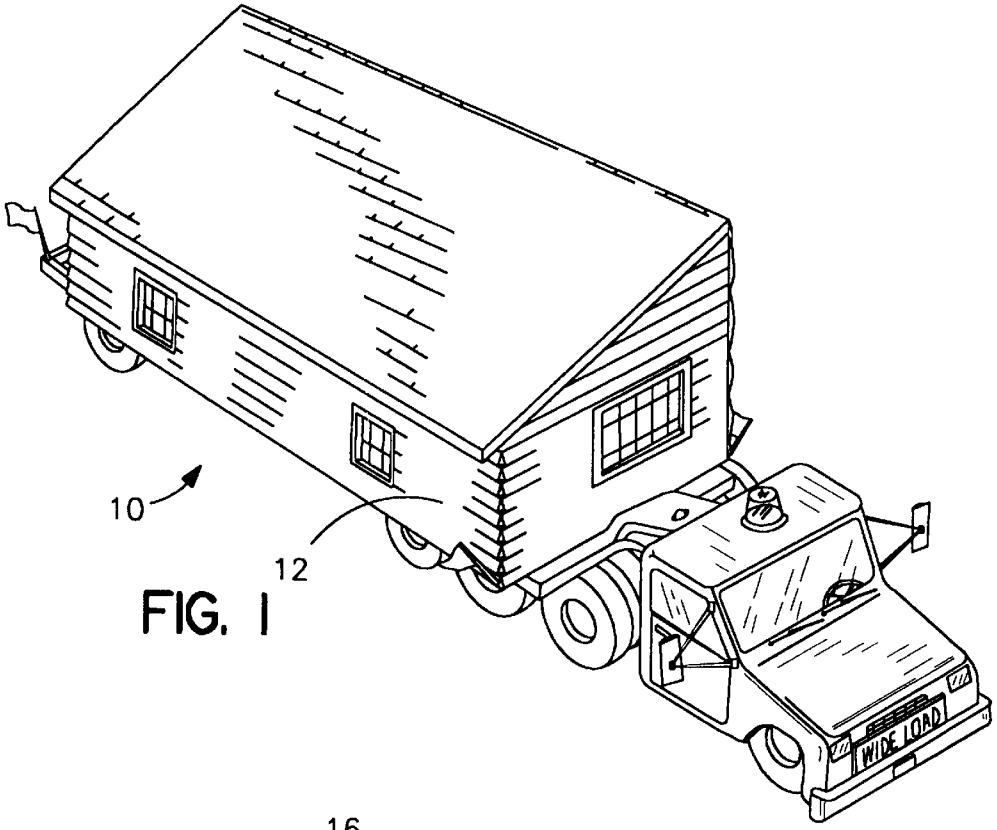
FIG. 1 is a perspective view of a prefabricated building with plastic siding being hauled over a road or highway to a building site.
Figure 2:
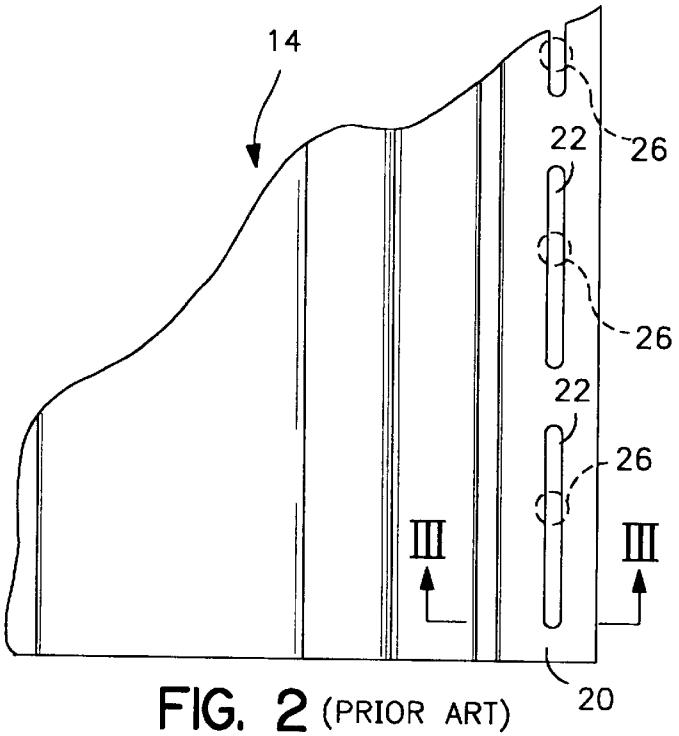
FIG. 2 (PRIOR ART)
FIG. 2 is a fragmentary front-elevational view of a plastic siding panel according to the prior art.
Figure 3:
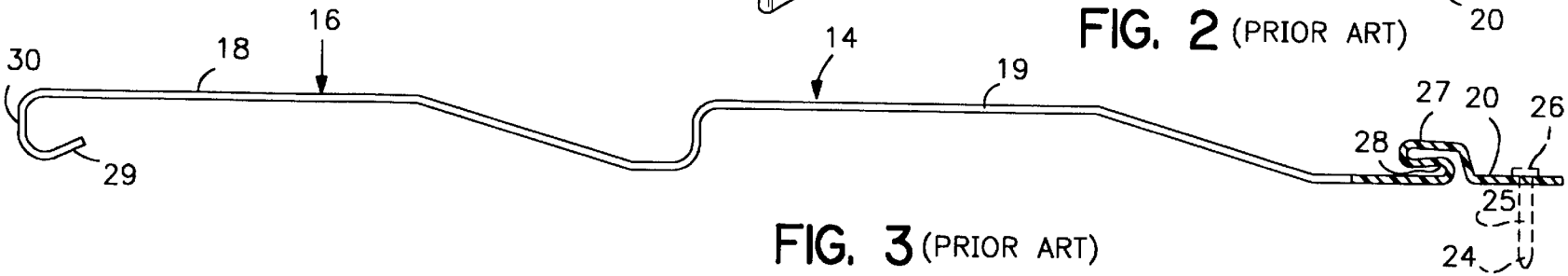
FIG. 3 (PRIOR ART)
FIG. 3 is a side view of the prior art siding panel shown in FIG. 2.

A module or section 10 of a prefabricated building having vinyl siding 12 is shown in FIG. 1 being transported along a highway to a building site where the module will be combined with another module or modules to form a complete building. Heretofore, ordinary vinyl siding of the type used on buildings constructed on the building site was used on modules 10 of prefabricated buildings. A known prior art vinyl siding panel 14 is shown in FIGS. 2 and 3. The known vinyl siding panel (FIG. 3) is comprised of a contoured sheet of a vinyl polymer, such as polyvinyl chloride, which is shaped to provide a facing surface 16 which simulates overlapping strips of wood. In the illustrated prior art vinyl siding panel 14, the vinyl sheet is contoured to simulate two beveled wood strips 18, 19. In siding panel 14, upper simulated strip 19 apparently, but does not actually, overlap the upper edge of lower strip 18 in order to simulate what is commonly referred to as a "Dutchlap" design.

The known panel 14 includes, at its upper edge, a flat nailhem strip 20 having a plurality of elongate apertures or slots 22 for fastening the vinyl panel 14 to an exterior wall of the module 10 using fasteners such as nails 24 (shown in phantom outline in FIG. 3). Nail 24 has a shank portion 25, which passes thorough a slot 22, and a head portion 26, the underside of which abuts the outer surface of the nailhem strip to firmly affix the panel 14 to the exterior wall of the module. Located immediately, adjacently below the nailhem strip 20 is an elongate hook-like projection 27 in the vinyl sheet 14. Hook-like projection 27 has an overlapping serpentine shape when viewed from the side edges as in FIG. 3. Projection 27 has an upwardly opening groove 28 for receiving an elongate prong 29 formed at the lower edge of a lower adjacent panel 14. More specifically, the lower edge or margin of panel 14 extends rearwardly, away from the facing 16 or outer side of panel 14, and upwardly, providing a generally J-shaped hook 30 which interlocks with projection 27 of a lower adjacent panel previously fastened to an exterior wall of a prefabricated building module 10. The lower portion of panel 14 conceals nailhem strip 20 and projection 27 of an adjacent lower panel. Accordingly, vinyl siding panels 14 are generally retained only along their upper edges, by fasteners 24, and along their lower edges, by interlocking engagement between hook 30 and projection 27 of a lower adjacent panel.

Siding 12 is generally installed by first securing a conventional lower trim strip (not shown) along a lower edge of building module 10. The lower trim strip includes a hook-like projection which is generally similar to the projection 27 of panel 14. The lowest row of panels 14 is then secured to the exterior wall of the building module by inserting hook 30 of panel 14 into the hook-like projection of the lower trim strip and fastening the upper edge of the panel to the exterior wall using fasteners passing through slots 22. The next highest row of panels 14 is installed in a similar manner by inserting hook 30 of a second row panel into projection 27 of a first row panel and fastening the upper edge of the second row panel to the exterior wall of the building. Third and successive row panels are installed in a similar manner. An upper trim strip (not shown) can be used to conceal the projection 27 of the highest row of panels 14.

The installed vinyl siding panels 14 provide the building module with a weather-resistant, decorative facade which has a simulated wood appearance. The known vinyl siding panels 14 are generally satisfactory for use on buildings which are constructed on the building site. However, for prefabricated buildings, wherein the building is substantially completely constructed at a factory or other site remote from the building site, and subsequently transported to the building site in the form of a plurality of individually-transportable modules 10, which are combined to form a complete building at the building site, a problem with conventional siding panels 14 is often encountered. Specifically, the modules 10 and siding 12 can be subjected to a very high apparent wind velocity as the modules are transported over a roadway, especially if the wind is blowing in a direction opposite to the direction which the modules are being moved. For example, a module 10 being hauled in a westerly direction at a speed of about 45 mph against an easterly wind of about 25 mph experiences an apparent wind velocity of 70 mph. While it is generally uncommon for a building facade to be subjected to such high wind velocities, sidings on prefabricated building modules are often subjected to an apparent wind velocity in excess of 50, 60 and even 70 mph when the modules are being transported The high apparent wind velocities to which siding on a prefabricated building module is sometimes exposed can, and frequently does, cause the vinyl siding panels to become loose at the bottom, which can cause air currents to get behind the siding panels. With conventional siding panels 14, the high apparent wind velocities which can be experienced during transportation of the prefabricated modules 10 can cause loose panels to be sheared off from the leading edge (facing the wind) rearwardly. Accordingly, it is often necessary to replace conventional vinyl siding panels 14 which have been completely torn off, and replace or refasten siding panels which have been partially dislodged, depending on the amount of damage, if any, to the partially dislodged panels.

The vinyl siding panels 110 of the invention, which include some similarities to those of the prior art, are shown in FIGS. 4–6. Panel 110 has a constant cross-sectional profile as shown in FIG. 6 and is comprised of a contoured sheet of a plastic material, such as a vinyl plastic composition containing a vinyl resin (for example, polyvinyl chloride), plasticizers, colorants, ultraviolet light stabilizers and other additives which can be employed in effective amounts as desired. Panels 110 can be formed by employing conventional plastic-forming techniques such as extrusion. Panel 110 includes an ornamental facing 116 which simulates overlapping wood strips 118, 119. Panel 110 also includes a nailhem strip 120 having a plurality of elongate apertures 122, and a hook-like projection 127. Projection 127 has an upwardly opening groove 128 for receiving an elongate prong 129 of a J-shaped hook 130 at the lower edge of a lower adjacent panel 110. Projection 127, and J-shaped hook 130 of panel 110 are substantially identical with, or similar to, the corresponding elements 27 and 30, respectively, of conventional vinyl siding panel 14.

The vinyl siding panel 110 of the invention also includes an elongate bump or rib 132 located on the nailhem strip 120. Preferably, rib 132 is integrally formed with nailhem strip 120. In a preferred embodiment, rib 132 can be located generally anywhere on the nailhem strip, except possibly along the fastener apertures 122, but is most preferably positioned at the upper edge of nailhem strip 120 as shown in FIGS. 46. The rib 132 is believed to provide additional strength and stiffness to the nailhem strip 120, which has been found to be effective in reducing or eliminating the occurrence of vinyl siding panels being partially or completely dislodged from the exterior walls of a prefabricated building module while it is being transported to a building site.

Rib 132 preferably has a generally curved cross-sectional profile as shown in FIGS. 4 and 6, but can also include linear portions and sharp edges if desired. The thickness of rib 132, i.e., the distance by which the rib projects outwardly away from the outer surface (facing or exposed side) of the nailhem strip 120, is preferably greater than the thickness of the panel 110 and less than the height of the hook-like projection 127. A suitable thickness for the rib is from about 0.05 to about 0.20 inch, and more desirably from about 0.10 to about 0.15 inch. The height of the rib 132 (i.e., the distance between flat portions of the nailhem strip 120 immediately adjacent opposite sides of the rib or, alternatively, if the rib 132 is at the upper end of the panel, the distance from the upper edge to the flat portion of the nailhem strip immediately adjacent the lower edge of the rib) is generally about one to about two times the thickness of the rib. A suitable rib height is from about 0.05 to about 0.40 inch, and more desirably from about 0.10 to about 0.30 inch.

The outer surfaces (facing away from the building wall) of rib 132 are preferably smoothly curved to facilitate easy extension of the panel. Rib 132 is preferably an integrally formed part of siding panel 110, and provides a stiffening function, which makes panel 110 more resistant to bending along a substantially vertical line and a reinforcing function which makes panel 110 more resistant to tearing at the nail region of the nailhem strip 120. Rib 132 is preferably disposed near the slots 22 where fasteners 26 are inserted, but is sufficiently spaced therefrom so that the head of the fasteners can abut the nailhem strip 120 without crushing the rib. Rib 132 projects outwardly, i.e., convexly away from the outer surface of the nailhem strip 120. The region between the exterior wall of a building structure to which panel 110 is fastened, and the underside of rib 132 is preferably hollow to reduce the amount of material used in making the siding panel and to facilitate easy forming (such as by extrusion) thereof. However, the panels can be formed so that the underside of rib 132 is filled and abuts the exterior wall of a building, if desired.

The embodiments of the invention in which an exclusive property or privilege is claimed are defined as follows:

We claim:

1. A siding panel for attachment to a building structure, comprising:

a contoured sheet of a plastic composition, said sheet having an outwardly facing surface, a generally flat nailhem strip at an upper end of said panel and disposed generally in a nailhem plane, said nailhem strip defining a plurality of elongate apertures adapted for passing fasteners therethrough to attach said panel to said building structure, and an elongate rib disposed on said nailhem strip away from said apertures and in predetermined registry therewith, said elongated rib comprising a first rib wall extending out of said nailhem plane on said outwardly facing surface side of said nailhem strip, a joining rib wall extending from said first rib wall to a second rib wall, said second rib wall extending back to said nailhem plane.

2. The siding panel of claim 1, wherein said elongate rib is disposed at the upper edge of said nailhem strip.

3. The siding panel of claim 2 wherein said siding panel has an ornamental facing surface adapted to be oriented away from a structure said siding panel is affixed to, and an inner surface adapted to be oriented facing a structure said siding panel is affixed to, said elongated rib has a smoothly curved cross section formed convexly relative to said siding panel outwardly facing surface.

4. The siding panel of claim 3, wherein said ornamental facing surface simulates wood strips.

5. The siding panel of claim 3, further comprising a hook-like projection adjacent said nailhem strip, said hook-like projection having an overlapping serpentine shape, as viewed from a side edge of said panel, and having an upwardly opening groove; and a J-shaped hook located at a lower end of said panel; said J-shaped hook being adapted to interlock with said hook-like projection of a lower adjacent panel to conceal said hook-like projection of said adjacent panel and secure the lower end of said siding panel.

6. The siding panel of claim 1, wherein said rib is about 0.05 to about 0.20 inch thick and about 0.05 to about 0.40 inch high.

7. The siding panel of claim 1, wherein said outwardly facing surface simulates wood strips.

8. A prefabricated building module which is transportable to a building site, and which can be combined with at least one other building module to form a substantially complete building, comprising:

at least one exterior wall, a siding panel facade covering said wall, said facade comprising a plurality of panels, each said panel comprising a contoured sheet of a plastic composition, said sheet having an outwardly facing surface, a generally flat nailhem strip at an upper end of said panel and disposed generally in a nailhem plane, said nailhem strip defining a plurality of elongate apertures adapted for passing fasteners therethrough to attach said panel to said building structure, and an elongate rib disposed on said nailhem strip away from said apertures and in predetermined registry therewith, said elongated rib comprising a first rib wall extending out of said nailhem plan on said outwardly facing surface side of said nailhem strip, a joining rib wall extending from said first rib wall to a second rib wall, said second rib wall extending back to said nailhem plane.

9. The building module of claim 8, wherein said elongate rib is located at the upper edge of said nailhem strip.

10. The building module of claim 9, wherein said rib is about 0.05 to about 0.20 inch thick and about 0.05 to about 0.40 inch high.

11. The building module of claim 10, wherein said siding panel has an ornamental facing surface adapted to be oriented away from a structure said siding panel is affixed to, and an inner surface adapted to be oriented facing a structure said siding panel is affixed to, said elongated rib has a smoothly curved cross section formed convexly relative to said siding panel outer surface.

12. The building module of claim 11, wherein said ornamental facing simulates wood strips.

13. The building module of claim 10, wherein said plastic sheet is of a composition comprising a vinyl resin.

14. The building module of claim 13, further comprising a hook-like projection adjacent said nailhem strip, said hook-like projection having an overlapping serpentine shape, as viewed from a side edge of said panel, and having an upwardly opening groove; and a J-shaped hook located at a lower end of said panel; said J-shaped hook being adapted to interlock with said hook-like projection of a lower adjacent panel to conceal said hook-like projection of said adjacent panel and secure the lower end of said siding panel.

* * * * *

UNITED STATES PATENT AND TRADEMARK OFFICE

CERTIFICATE OF CORRECTION

PATENT NO. : 6,026,624
DATED : February 22, 2000
INVENTOR(S) : Kiran A. Patel and Steven F. Quady It is certified that error appears in the above-identified patent and that said Letters Patent is hereby corrected as shown below:

Column 4,
Line 54: "46" should be -- 4-6 --.

Claim 5,
Line 1: "claim 3" should be -- claim 2 --.

Signed and Sealed this

Twenty-first Day of August, 2001

*Attest:*

Nicholas P. Godici

*Attesting Officer*

NICHOLAS P. GODICI
*Acting Director of the United States Patent and Trademark Office*